US005356234A

United States Patent [19]

Vangool

[11] Patent Number: 5,356,234

[45] Date of Patent: Oct. 18, 1994

[54] SEPARABLE JOINT FOR ARM AND HUB CONSTRUCTIONS

[75] Inventor: William Vangool, Nepean, Canada

[73] Assignee: 506567 Ontario Limited, Ottawa, Canada

[21] Appl. No.: 966,423

[22] Filed: Oct. 26, 1992

[51] Int. Cl.[5] ..... E04B 1/19; E04B 1/58

[52] U.S. Cl. ..... 403/170; 403/171; 52/646

[58] Field of Search ..... 403/291, 169, 170, 174, 403/178, 217, 218, 171; 52/646

[56] References Cited

U.S. PATENT DOCUMENTS

| | | | |
|---|---|---|---|
| 2,931,467 | 4/1960 | Fentiman | 403/171 |
| 3,275,351 | 9/1966 | Fentiman | 403/171 |
| 3,452,452 | 7/1969 | Dore | 403/292 |
| 3,527,486 | 9/1970 | Gamp | 403/292 |
| 3,715,136 | 2/1973 | Yoshida | 403/292 |
| 4,951,440 | 8/1990 | Staeger | 52/646 |

FOREIGN PATENT DOCUMENTS

| | | | |
|---|---|---|---|
| 640730 | 5/1962 | Canada . | |
| 647419 | 8/1962 | Canada . | |
| 714248 | 7/1965 | Canada . | |
| 964833 | 3/1975 | Canada . | |
| 2102466 | 2/1983 | United Kingdom | 403/170 |

*Primary Examiner*—P. Austin Bradley
*Assistant Examiner*—Rex E. Pelto
*Attorney, Agent, or Firm*—Howrey & Simon

[57] ABSTRACT

There is provided an improved separable joint for arm and hub constructions for structural frameworks. The separable joint comprises a hub having sides and opposite ends. A plurality of spaced, longitudinal, parallel apertures extend end to end through the hub positioned towards the sides of the hub. Parallel, longitudinally extending slots extend between the sides of the hub and central portions of the apertures. An elongated spline is provided having ends and sides. A keyway slot extends from end to end through the spline and opening to one side. The sides of the spline are contoured to conform to the sides of the corresponding apertures in the hub and to be releasable received therein with the keyway slot opening and the hub aperture slot aligned adjacent to each other. The spline has secured in its keyway slot a co-operative interlocking key formed in an end of a corresponding arm. Securing means are provided at the ends of the hub to prevent accidental removal of the splines and associated arms when in position in the hub apertures.

8 Claims, 2 Drawing Sheets

SEPARABLE JOINT FOR ARM AND HUB CONSTRUCTIONS

BACKGROUND OF THE INVENTION

The present invention relates to improvements in structural framework and more particularly relates to an improved separable joint for rod and hub constructions used for example in the fabrication of scaffolds, trusses, bridges, walls, roofs, towers, space frames, engineering structures and assemblies of a wide variety.

PRIOR ART

U.S. Pat. No. 2,931,467 of Arthur E. Fentiman issued Apr. 5, 1960, describes and illustrates a structural framework comprising hollow cylindrical tubes of aluminum or other suitable metal. The ends of those tubes can be cut and embossed in a single operation to provide a flared locking tenon or key. Such tubular members are hereinafter referred to as "arms", which term is intended to include any suitable and comparable component such as tubes, struts, and any other elongated and preferably, though not necessarily, cylindrical members. A hub, with radially disposed keyway mortis slots but are elongated parallel with the hub axis and opened at both ends, into which the locking tenon ends of the arms are insertable, serves as the connector for any desired number and arrangement of divergent arms. A securing means for the ends of the hub, for example, a bolt with end washers and co-operating nut, is used to retain the arms against displacement and may also act to couple two or more hubs or hub and arm arrangements, in axial alignment. The hub is preferably in cylindrical form having a plurality of circumferentially spaced, radially disposed sockets formed as deep grooves running the full length of the hub. These longitudinally extending grooves or sockets have had ridges and troughs on opposite side walls that parallel the hub's axis and appear as narrow head keyways when seen from the end of the hub. The arms, which have conventionally been hollow aluminum tubes, are flattened and are provided, on opposite sides, with transversely disposed grooves and ridges to correspond with the width and contour of the socket grooves in the hub into which they are laterally inserted edgewise. Where the small groove and ridge keys run directly across the arm ends, the arms normally radiate from the hub in the same plane as the hub. By disposing the groove and ridge keys at an angle for instance of 60° or 45° to the transverse line, the arms will diverge at 60° or 45° respectively from the plane of the hub. In this manner, a variety of structures, using these simple hub and arm components, can be built.

Patents of background interest, describing specific improvements on this hub and arm type of construction are Canadian Patent No. 640,730 issued May 1, 1962, Canadian Patent No. 647,419, issued Aug. 28, 1962, and Canadian Patent No. 714,248, issued Jul. 27, 1965, all of these patents naming Arthur E. Fentiman as inventor.

One of the problems that is inherent in such arm and hub assemblies has arisen from the close tolerance by which the hub keyways and arm keys must be formed to ensure a rigid structure. Because of the size and complexity of many of the structures built using such constructions, skilled workers and significant time have been required to assemble the hubs and arms during installation and overcome problems of tightness and binding in the keyway—key connections. Another difficulty, arising from the close tolerances required in this construction has been the fact that the joints have tended to fuse, for example when subjected to moist or other corrosive environments, making their separation for removal, repair or alteration extremely difficult.

A somewhat different type of joint for structural assemblies is described and illustrated in Canadian Patent No. 964,833 of Summerstein issued Mar. 25, 1975, where a circumferential disposition of slotted apertures is taught in a hub assembly. The slotted apertures are tapered from top to bottom and the ends of the tubular arms are formed in tubular, tapered fashion to snugly fit in the hub's apertures. Pins are seated in the tubular ends of the members to facilitate securing those ends in their corresponding apertures.

It is an object of the present invention to provide an improved separable joint for such hub and arm structures which is easier to assemble yet which maintains the structural strength and rigidity of hub and arm constructions with conventional separable joints. It is a further object of the present invention to provide such a separable joint which is less prone to seizing of the components due to corrosion.

SUMMARY OF THE INVENTION

In accordance with the present invention there is provided an improved separable joint for structures of the type emboding a keyway-type connector with separable arms engaged therewith and secured against accidental displacement therefrom by securing means. In accordance with the present invention, the connector comprises a hub having sides and opposite ends. A plurality of spaced, longitudinal, parallel apertures extend end to end through the hub positioned towards the sides of the hub. Parallel, longitudinally extending slots extend between the sides of the hub and central portions of the apertures. An elongated spline is provided having ends and sides. A keyway slot extends from end to end through the spline and opening to one side. The sides of the spline are contoured to conform to the sides of the corresponding apertures in the hub and to be releasable received therein with the keyway slot opening and the hub aperture slot aligned adjacent to each other. The spline has secured in its keyway slot a co-operative interlocking key formed in an end of a corresponding arm. Securing means are provided at the ends of the hub to prevent accidental removal of the splines and associated arms when in position in the hub apertures.

In a preferred embodiment of the present invention, the hub is of cylindrical shape and has its apertures circumferentially spaced towards the periphery of the sides of the hub. The apertures may be of any appropriate transverse cross-sectional shape such as circular, oval (with the longitudinal axis of the oval preferably radially oriented in the hub), triangular (with an apex of each triangle oriented towards its corresponding slot), etcetera.

The separable joint arrangement of the present invention permits easy construction and dismantling of hub and arm structures of the type in question with consequent savings in time and effort of assembly and disassembly of those structures.

BRIEF DESCRIPTION OF THE DRAWINGS

These and other objects and advantages of the invention will become apparent upon reading the following detailed description and upon referring to the drawings in which.

Figure 1:
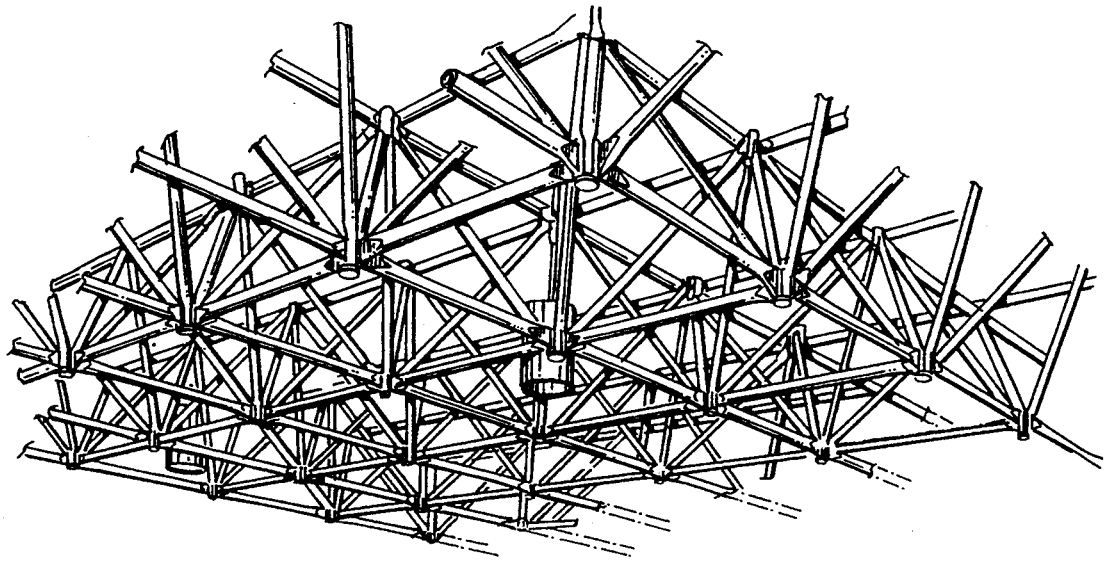
FIG. 1 is a perspective view of a structure incorporating a separable joint construction in accordance with the present invention.

While the invention will be described in conjunction with example embodiments, it will be understood that it is not intended to limit the invention to such embodiments. On the contrary, it is intended to cover alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings there is illustrated in FIGS. 1 and 2*a* separable joint construction 2 in accordance with the present invention. As with conventional separable joint constructions of the hub and arm type that of the present invention incorporates a hub connector 4 with separable arms 6 engaged therewith and secured against accidental displacement by end members 8, of appropriate construction. In the joint construction of the present invention, however, hub 4 is provided with a plurality of longitudinal parallel apertures 10 extending end to end through the hub and spaced towards its sides. Where, as illustrated, the hub is of cylindrical shape, the apertures are circumferentially spaced and radially disposed. Centrally, positioned along each of apertures 10 are parallel, longitudinal slots 12 extending between the apertures and the corresponding sides of the hub.

Figure 3:
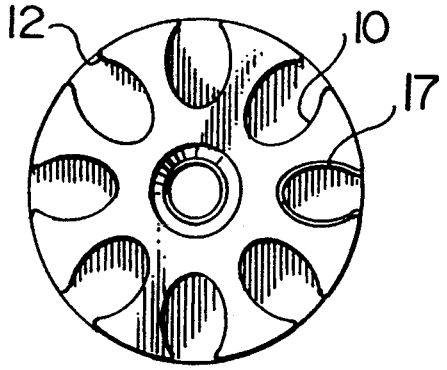
FIGS. 3 and 3*a* are plan views illustrating the separable joint in construction of FIG. 2.
Figure 3A:
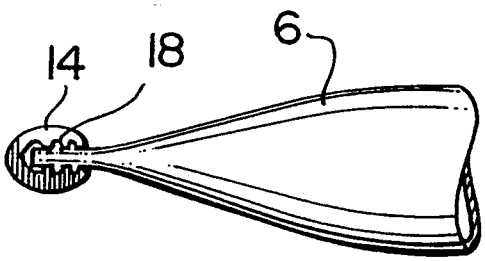
Figure 4:
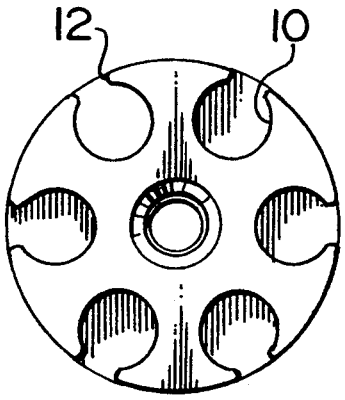
FIGS. 4 and 4*a* and 5 and 5*a* are respectively plan views of alternative embodiments of hub and spline constructions in accordance with the present invention.
Figure 4A:
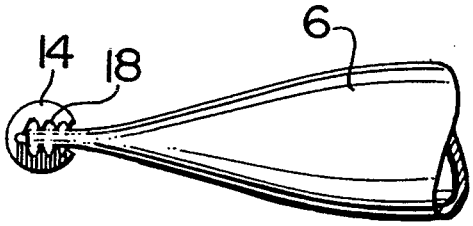
Figure 5:
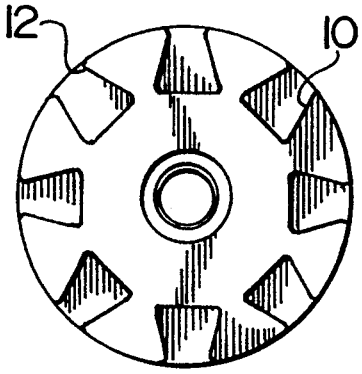
Figure 5A:
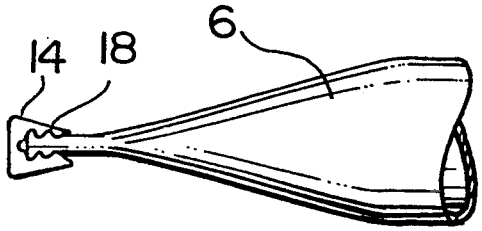

As can be seen in FIGS. 3*a*, 4*a* and 5*a*, the apertures 10 may be of any appropriate cross-sectional configuration such as oval (FIG. 3) with the longitudinal axis of the oval radially oriented in the hub, circular (FIG. 4) or triangular (FIG. 5). Other configurations not illustrated would of course be suitable.

Figure 2:
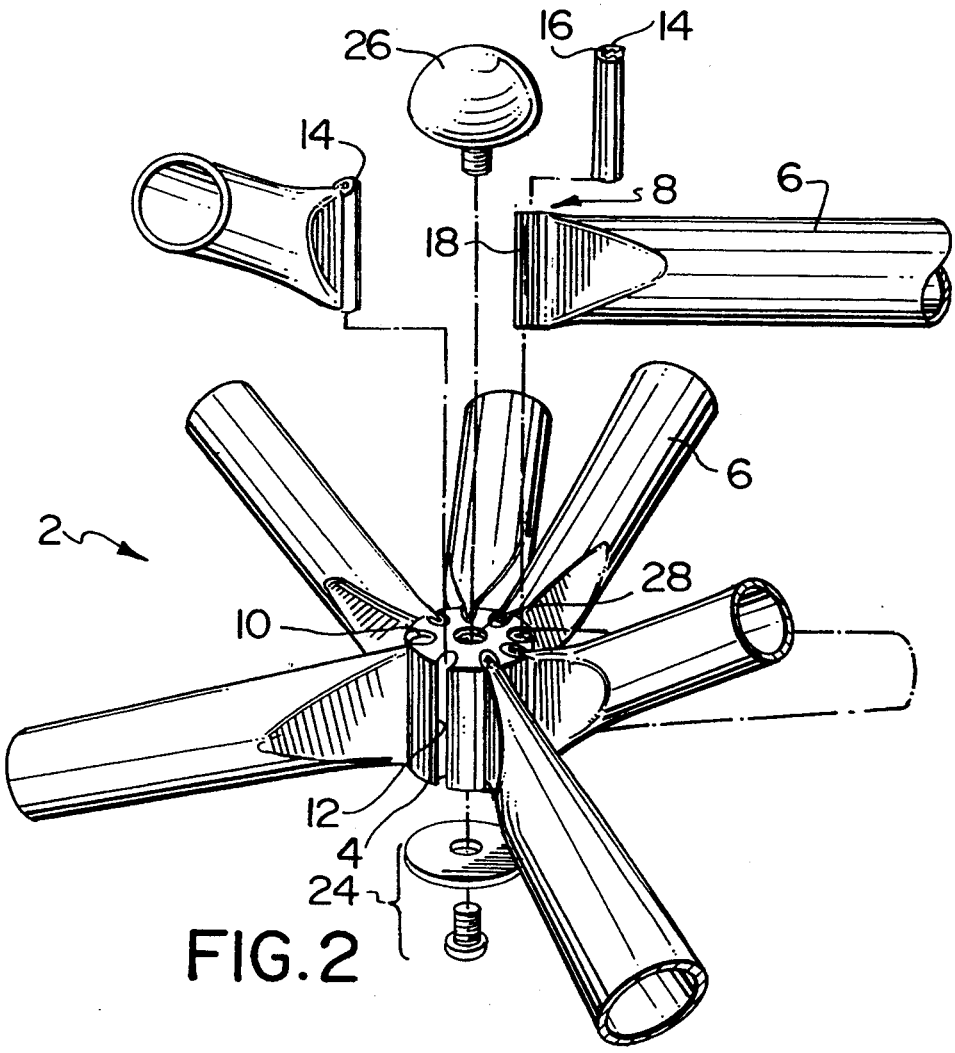
FIG. 2 is an exploded perspective view of a separable joint construction in accordance with the present invention.

Conforming to the shape of apertures 10 are a plurality of elongated splines 14 having keyway slots 16 extending from end to end through each spline and opening to one side as illustrated, the sides of the splines 16 are contoured to conform to the sides of the apertures 10 to be releasably received therein with the keyway slot opening and the hub aperture slot aligned adjacent to each other as illustrated in FIG. 2. The splines are of a size slightly smaller than the size of the corresponding aperture 10, so that they are easily insertable into and removable from aperture 10. This tolerance is preferably 2% and may permit, for example, the inclusion of a MYLAR (trade-mark) or other layer or film between the inner walls of apertures 10 and the outer sides of splines 14 (as illustrated in one of the apertures in FIG. 3), to resist the seizing of splines 14 when seated in apertures 10, through corrosion or otherwise. Each spline 14 receives and secures in its keyway slot 16 a co-operative, interlocking key 18 in the end of a corresponding arm 6. The keyways and keys of spline 14 and arms 6 are of the conventional small groove and ridge type, which run normal to the longitudinal axis of the arms or are disposed at an appropriate angle thereto, as described in more detail for example in U.S. Pat. No. 2,931,467.

To ensure that splines 14 and associated arms 6 are retained within apertures 10, securing means such as a bolt and washer arrangement 24 or a releasable bolt with a decorative head 26 may be threadably engaged for example to a central threaded aperture 28 in hub 4.

The separable joint arrangement 2 as described herein in accordance with the present invention, permits easy construction and dismantling of hub and arm structures of the type in question, since the careful alignment of hubs and arms which was necessitated by the previous conventional keyway—key hub and arm constructions is no longer required. Thus time and effort in assembly and disassembly of structures in using the joint of the present invention is made easier and less expensive. As well, seizing or binding of the joints during or after construction is reduced. Moreover, despite the greater tolerances provided by the joint construction of the present invention, it has been found that as a structure is assembled using the arm/hub construction of the present invention, the splinese of the ends of the arms become firmly seated in the apertures in a self-tightening fashion when loads are placed on the hubs and arms as construction progresses.

Thus it is apparent that there has been provided in accordance with the invention improved separable joint for arm and hub constructions that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a separable joint embodying a keyway-type connector with separable arms engaged therewith and secured against accidental displacement therefrom by securing means, the improvement characterized in that the connector comprises:

(a) a hub having sides and opposite ends, a plurality of spaced, longitudinal, parallel apertures extending end to end through the hub positioned towards the sides of the hub and parallel, longitudinally extending slots extending between the sides of the hub and central portions of the apertures;

(b) an elongated spline having ends and sides, a keyway slot extending from end to end through the spline and opening to one side, the sides of the spline contoured to conform to the sides of the corresponding apertures in the hub and to be releasable received therein with the keyway slot opening and the hub aperture slot aligned adjacent each other, the spline being spaced from the aperture to form a tolerance therebetween permitting a limited rang of rotation of the arm relative to the hub, said spline being means for providing a secure, but relatively loose fit and facilitating assemble and disassembly of the joint, and the spline having fixedly secured in its keyway slot a co-operative interlocking key formed in an end of a corresponding arm; and (c) securing means at the ends of the hub to prevent accidental removal of the splines and associated arms when in position in the hub apertures.

2. The joint of claim 1 wherein the hub is of cylindrical shape and has its apertures circumferentially spaced towards the periphery of the sides of the hub.

3. The joint of claim 2 wherein the apertures are of circular transverse cross-section.

4. The joint of claim 2 wherein the apertures are of oval cross-section with the longitudinal axis of the oval radially oriented in the hub.

5. The joint of claim 2 wherein the apertures are of triangular transverse cross-section with an apex of each triangle oriented towards its corresponding slot.

6. The joint of claim 1 wherein the sides of the splines fit within the sides of the apertures with a tolerance of 2%, to provide a secure, but relatively loose fit.

7. The joint of claim 1 wherein a layer of anti-corrosive, synthetic material is provided between the aperture wall and the sides of the corresponding spline.

8. The joint of claim 7 wherein the layer is of MYLAR (trade-mark).

* * * * *